US007544101B1

(12) United States Patent
Tseng

(10) Patent No.: US 7,544,101 B1
(45) Date of Patent: Jun. 9, 2009

(54) CAR POWER PLUG AND ELECTRONIC DEVICE HAVING THE CAR POWER PLUG

(75) Inventor: Tien-Chung Tseng, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 0 days.

(21) Appl. No.: 12/197,260

(22) Filed: Aug. 24, 2008

(30) Foreign Application Priority Data

Feb. 13, 2008 (TW) ..... 97104999 A

(51) Int. Cl.
*H01R 24/04* (2006.01)

(52) U.S. Cl. ..... 439/668; 439/131

(58) Field of Classification Search ..... 439/131, 439/668, 669, 640
See application file for complete search history.

(56) References Cited

U.S. PATENT DOCUMENTS 5,906,509 A * 5/1999 Wu ..... 439/518
7,040,932 B1 * 5/2006 Klitzner ..... 439/668

* cited by examiner

*Primary Examiner*—Neil Abrams
*Assistant Examiner*—Phuong Nguyen
(74) *Attorney, Agent, or Firm*—Stephen A. Bent; Foley & Lardner LLP

(57) ABSTRACT

An electronic device having a car power plug is adapted for insertion into a car cigarette lighter socket to obtain power therefrom. The electronic device includes a housing, a first input terminal disposed in the housing, a second input terminal disposed in the housing, a first insert plate, and a conducting member. The first insert plate is disposed on the housing, and includes an insulating body dimensioned with reference to the lighter socket, and a conducting portion provided on one side of the insulating body. The conducting portion is connected electrically to the second input terminal, and is adapted to contact an inner wall surface of the lighter socket. The conducting member is provided at a front end of the first insert plate and is connected electrically to the first input terminal. The conducting member is adapted to abut against a bottom end of the lighter socket.

18 Claims, 5 Drawing Sheets

CAR POWER PLUG AND ELECTRONIC DEVICE HAVING THE CAR POWER PLUG

CROSS-REFERENCE TO RELATED APPLICATION

This application claims priority of Taiwanese Application No. 097104999, filed on Feb. 13, 2008.

BACKGROUND OF THE INVENTION

1. Field of the Invention

The invention relates to a power plug, more particularly to a car power plug that is insertable into a car cigarette lighter socket.

2. Description of the Related Art

Cars are generally provided with a cigarette lighter. The cigarette lighter has a socket body and a plug provided with an electric heating element. When the plug is inserted into the socket body and is pressed inward, the heating element of the plug will be electrically connected to the socket body and becomes heated instantly. A user can then take out the plug and use the heating element to light a cigarette.

In order to better utilize the power supplied via the cigarette lighter socket, a power plug for electrical connection to the cigarette lighter socket to obtain supply of electric power has been developed. Moreover, in order to match the shape of the cigarette lighter socket, a conventional power plug is configured to have a cylindrical structure. FIG. 1 shows a power plug 9 disclosed in R.O.C. Utility Model No. 95200092, which has two conductive pieces 91 provided respectively on two diametrically opposite sides thereof for electrical connection with negative power terminals in a car cigarette lighter socket (not shown), and a conductive block 92 projecting from a front end thereof for electrical connection with a positive power terminal in the cigarette lighter socket. Power plugs for cars as disclosed in R.O.C. Utility Model Nos. 94212951, 91206155 and 90204504 are also cylindrical plugs.

Since the size of such a power plug 9 is relatively large, if the power plug 9 is to be integrated with an electronic device or configured to be foldably accommodated in an electronic device, the overall size of the electronic device will be inevitably increased in order to provide a sufficient space for accommodating the power plug 9. Thus, miniaturization of modern electronic equipment that is desired to be compact cannot be effectively achieved.

SUMMARY OF THE INVENTION

Therefore, an object of the present invention is to provide a car power plug having a plate structure, which is different from the conventional cylindrical power plug.

Another object of the present invention is to provide a car power plug that is integrated with an electronic device and that permits miniaturization of the electronic device.

Accordingly, an electronic device having a car power plug of the present invention is adapted to be inserted into a car cigarette lighter socket to obtain power therefrom. The electronic device includes a housing, a first input terminal disposed in the housing, a second input terminal disposed in the housing, a first insert plate, and a conducting member. The first insert plate is disposed on the housing, and includes an insulating body that is dimensioned with reference to a diameter of the cigarette lighter socket, and a conducting portion disposed on one side of the insulating body. The conducting portion is connected electrically to the second input terminal, and is adapted to contact an inner wall surface of the cigarette lighter socket. The conducting member is disposed at a front end of the first insert plate, and is connected electrically to the first input terminal. The conducting member is adapted to abut against a bottom end of the cigarette lighter socket.

Preferably, the electronic device having a car power plug according to the present invention has a first receiving recess formed in one face of the housing. The first insert plate is accommodated in the receiving recess. The first insert plate is switchable between a stowage position, where the first insert plate is stowed in the first receiving recess, and a position of use, where the first insert plate is away from the first receiving recess for insertion into the cigarette lighter socket. The insulating body of the first insert plate has one end portion connected pivotally to a rear face of the housing and disposed in the first receiving recess such that the first insert plate is pivotable relative to the first receiving recess between the stowage position and the position of use. The advantageous effect of the present invention resides in that the plate-like structure of the car power plug of the present invention, which is different from conventional cylindrical car power plugs, permits a reduction in manufacturing costs and facilitates carrying of the electronic device using the same. In addition, since the car power plug is integrated with the electronic device, the car power plug may be connected electrically to the cigarette lighter socket without additionally requiring a conventional power plug and a power adapter. Furthermore, since the first insert plate is stowable in the housing of the electronic device, the overall size of the electronic device will not increase.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
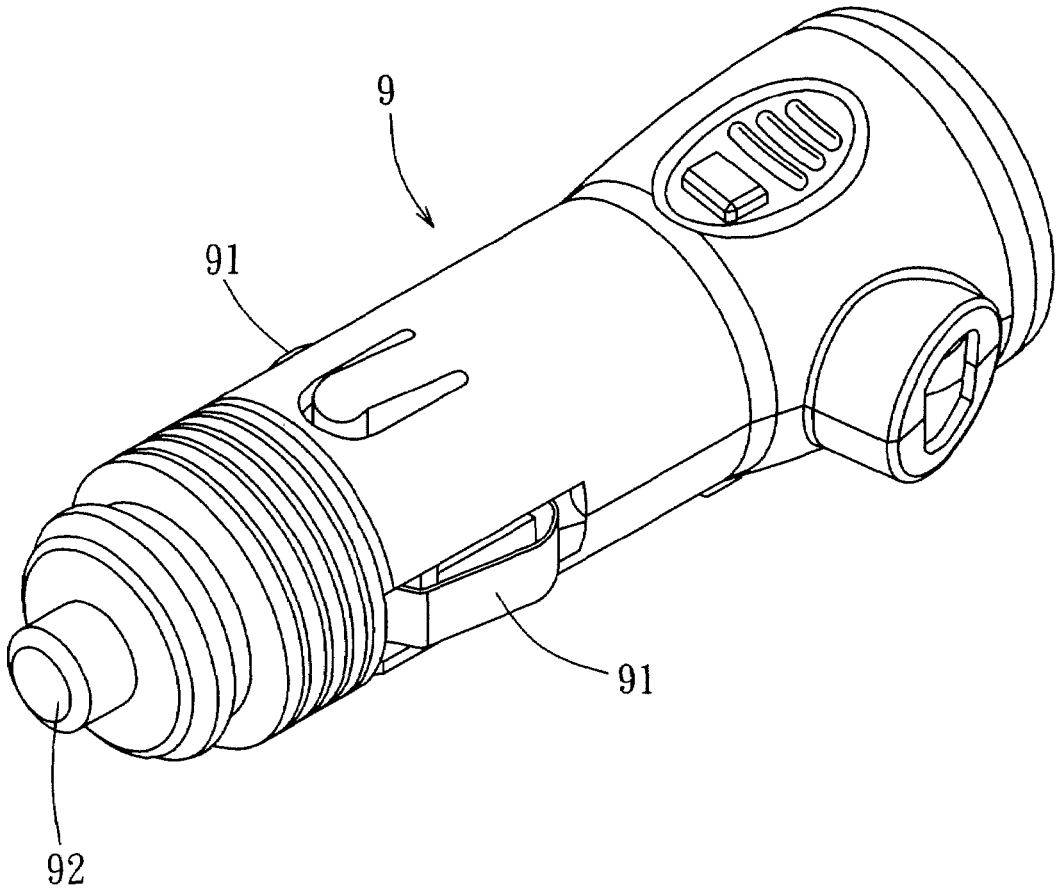
FIG. 1 PRIOR ART
FIG. 1 is a perspective view to illustrate a conventional cylindrical car cigarette lighter plug.

Before the present invention is described in greater detail, it should be noted that like elements are denoted by the same reference numerals throughout the disclosure.

Figure 2:
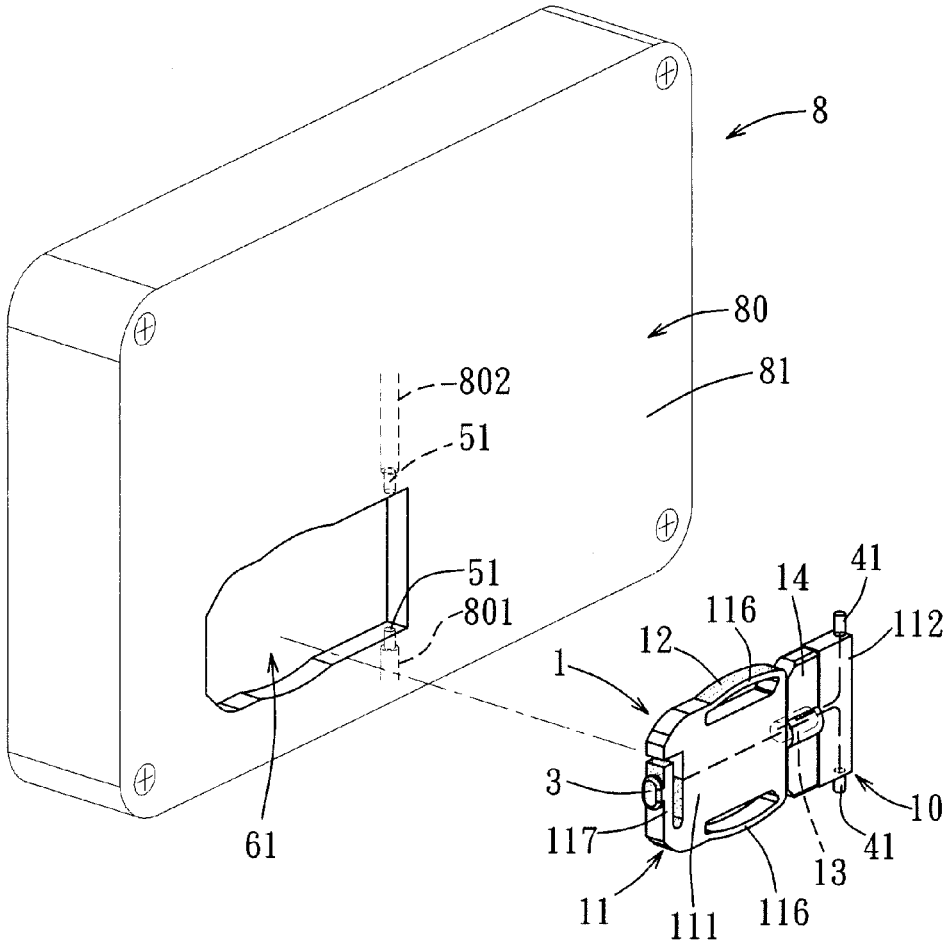
FIG. 2 is a partly exploded perspective view to illustrate the first preferred embodiment of an electronic device having a car power plug according to the present invention.
Figure 3:
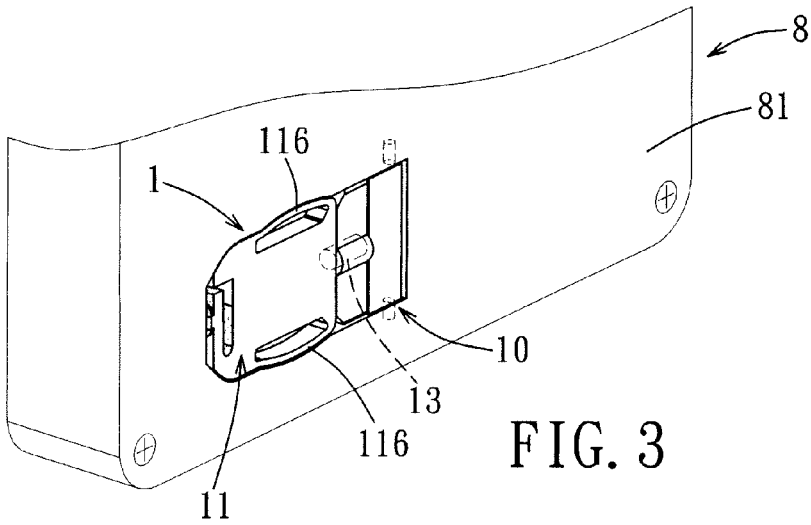
FIG. 3 is a fragmentary perspective view to illustrate a first insert plate of the first preferred embodiment in a stowage position.
Figure 4:
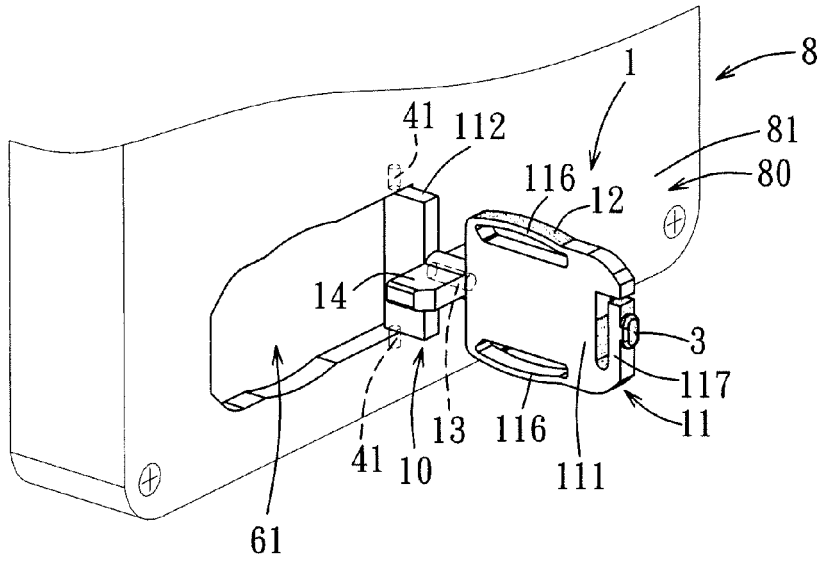
FIG. 4 is a fragmentary perspective view to illustrate the first insert plate of the first preferred embodiment in a position of use.

FIGS. 2 to 4 illustrate the first preferred embodiment of an electronic device 8 having a car power plug 10 according to the present invention. The car power plug 10 is insertable into a car cigarette lighter socket (not shown) to be electrically connected to a car battery (not shown) via positive and negative power terminals (not shown) in the cigarette lighter socket. In the preferred embodiment, the electronic device 8 includes a housing 80, a first input terminal 801 provided in the housing 80, a second input terminal 802 provided in the housing 80, and the car power plug 10, which is connected pivotally to the housing 80. The car power plug 10 includes a first insert plate 1 that is generally rectangular and that is provided on the housing 80, and a conducting member 3 provided at a front end of the first insert plate 1. In the embodiments to be described hereinafter, the first input terminal 801 is a positive input terminal, and the second input terminal 802 is a negative input terminal.

The housing 80 has a rear face 81 formed with a first receiving recess 61. The first receiving recess 61 is a receiving space that is shaped to match that of the first insert plate 1 for receiving the generally rectangular first insert plate 1 such that the first insert plate 1 does not protrude from the rear face 81 of the housing 80 to avoid increasing the size of the electronic device 8.

The first insert plate 1 includes an insulating body 11 dimensioned with reference to the diameter of the cigarette lighter socket, two conducting portions 12 provided respectively on two sides of the insulating body 11, and a blocking member 14. The first insert plate 1 is switchable between a stowage position where the first insert plate 1 is stowed in the first receiving recess 61, and a position of use where the first insert plate 1 is away from the first receiving recess 61 to be adapted to be inserted into the cigarette lighter socket. The switching movement of the first insert plate 1 will be described in greater detail hereinbelow.

The insulating body 11 of the first insert plate 1 has a positioning portion 112, a pivot shaft 13, and a plug portion 111. Two coaxial first pivot pins 41 are provided respectively on two opposite sides of the positioning portion 112. The first pivot pins 41 are formed from an electrically conductive material (e.g., copper). The first insert plate 1 is connected pivotally to one side of the first receiving recess 61 through the two first pivot pins 41. The pivot shaft 13 extends from one end of the plug portion 111 to the positioning portion 112. The blocking member 14 is provided pivotally on the pivot shaft 13, and is interposed between the plug portion 111 and the positioning portion 112. The blocking member 14 is rotatable about the pivot shaft 13 between a non-fixing position where the block member 14 is co-planar with the plug portion 111 and a fixing position where the blocking member 14 is not co-planar with the plug portion 111.

The housing 80 is formed with two pin holes 51 at a lateral end of the first receiving recess 61 for extension of the pivot pins 41 thereinto, respectively, such that the first insert plate 1 is pivotable about the first pivot pins 41 between the stowage position (see FIG. 3) where the first insert plate 1 is stowed in the receiving recess 61, and the position of use (see FIG. 4) where the first insert plate 1 is away from the first receiving recess 61 so as to be insertable into the cigarette lighter socket.

The plug portion 111 of the insulating body 11 is formed with two outwardly projecting resilient wings 116 on two opposite sides thereof, which are adapted to contact an inner wall surface of the cigarette lighter socket, and the conducting portions 12 are provided respectively on outer surfaces of the resilient wings 116. It is noted that the plug portion 111 may be provided with only one resilient wing 116, so long as the conducting portion 12 thereon is able to contact the inner wall surface of the cigarette lighter socket. Those having ordinary skill in the art to which the present invention pertains should readily appreciate that the present invention can be modified in the number of components or elements.

A front end of the plug portion 111 of the first insert plate 1 is formed with an L-shaped resilient arm 117. The conducting member 3 is disposed on a front lateral side of the resilient arm 117 for abutting against the positive power terminal in the cigarette lighter socket, so as to establish electrical connection between the first input terminal 801 of the electronic device 8 and the positive power terminal.

Thus, when the first insert plate 1 is disposed in the position of use and is inserted into the cigarette lighter socket, the conducting portions 12 are in contact with the inner wall surface of the cigarette lighter socket to enable the second input terminal 802 of the electronic device 8 to electrically connect with the negative power terminal. At the same time, the conducting member 3 abuts against the positive power terminal in the cigarette lighter socket to enable the first input terminal 801 of the electronic device 8 to connect with the positive power terminal.

When the first insert plate 1 is in the position of use, and when the blocking member 14 is in the fixing position, the blocking member 14 blocks access to the cigarette lighter socket, so that the first insert plate 1 is maintained in a state that only the plug portion 111 is insertable into the cigarette lighter socket, thereby enhancing the stability of the entire car power plug 10. When the blocking member 14 is disposed in the non-fixing position, since the first insert plate 1 is co-planar with the insulating body 11, the first insert plate 1 is movable to the stowage position.

The conducting portions 12 and the conducting member 3 of the car power plug 10 may be connected electrically and respectively to the electronic device 8 in various ways. For example, the first insert plate 1 may be sprayed with an electrically conductive paint to form an electrical connection path, or may be plated with a conductive metal layer to form an electrical connection path. Alternatively, state-of-the-art injection forming techniques may even be employed to embed painted wire or metal wire into the first insert plate 1 to form an electrical connection path. Those having ordinary skill in the art to which the present invention pertains should be familiar with various ways to establish electrical connections.

Figure 5:
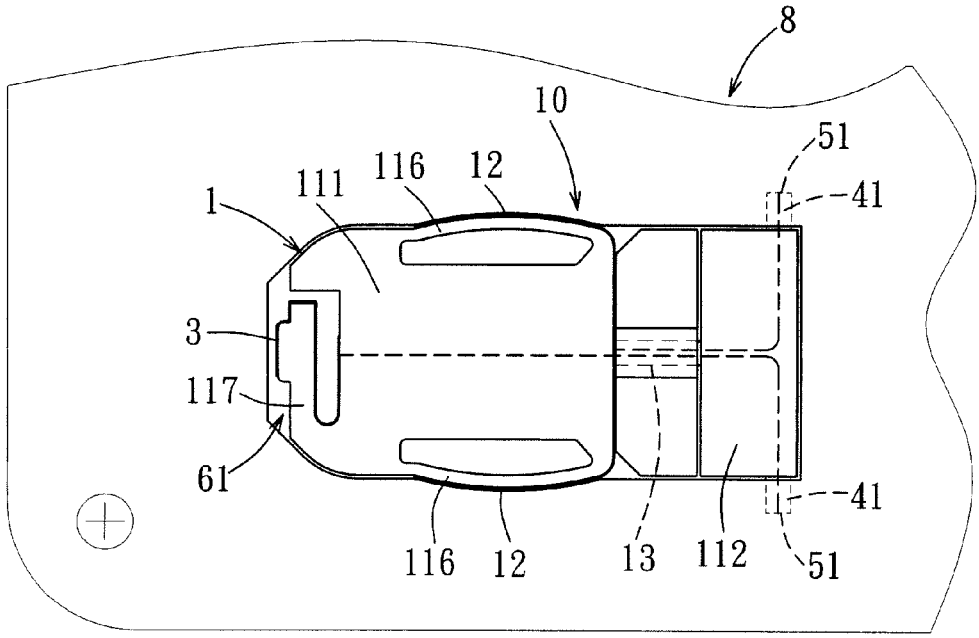
FIG. 5 is a fragmentary side view to illustrate the first insert plate of the first preferred embodiment in the stowage position.

The manner of establishing electrical connection in the first preferred embodiment is described with reference to FIG. 5. When the car power plug 10 is in the position of use, the conducting member 3 is able to contact the positive power terminal of the cigarette lighter socket. Electric current flows along conductive paint covering an outer surface of the resilient arm 117 to a lead wire embedded in the plug portion 111. The lead wire extends into the positioning portion 112 via the pivot shaft 13 to be electrically connected to one of the first pivot pins 41, thereby establishing an electrical connection with the first input terminal 801 of the electronic device 8 through said one of the first pivot pins 41. The conducting portions 12 disposed respectively on the two resilient wings 116 are covered with two layers of conductive paint, and are electrically connected to the other one of the two first pivot pins 41 through the lead wire embedded in the plug portion 111 and leading to the positioning portion 112 via the pivot shaft 13, thereby establishing an electrical connection with the second input terminal 802 of the electronic device 8 through said other one of the two pivot pins 41.

Figure 6:
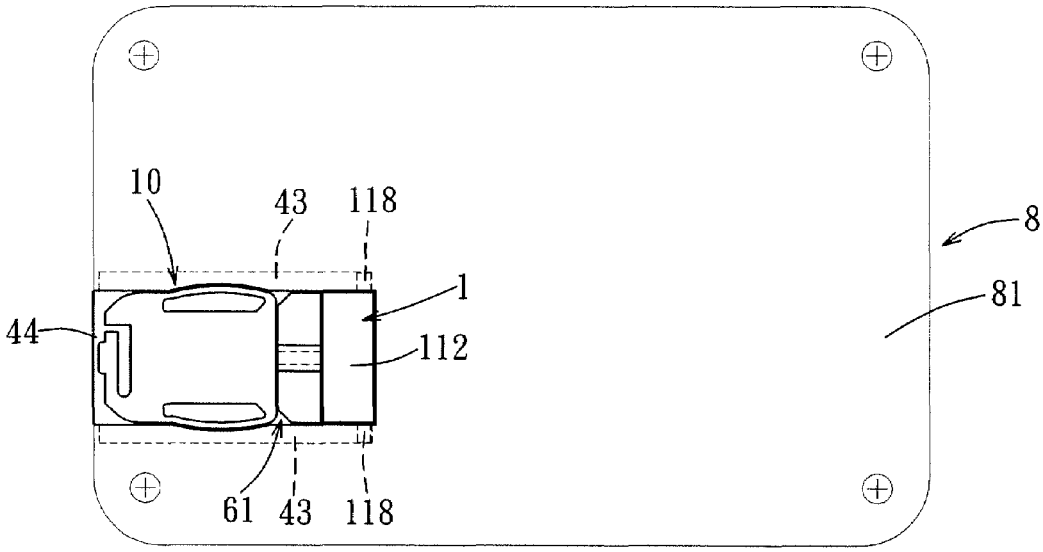
FIG. 6 is a side view to illustrate the second preferred embodiment of an electronic device having a car power plug according to the present invention, showing a first insert plate in a stowage position.
Figure 7:
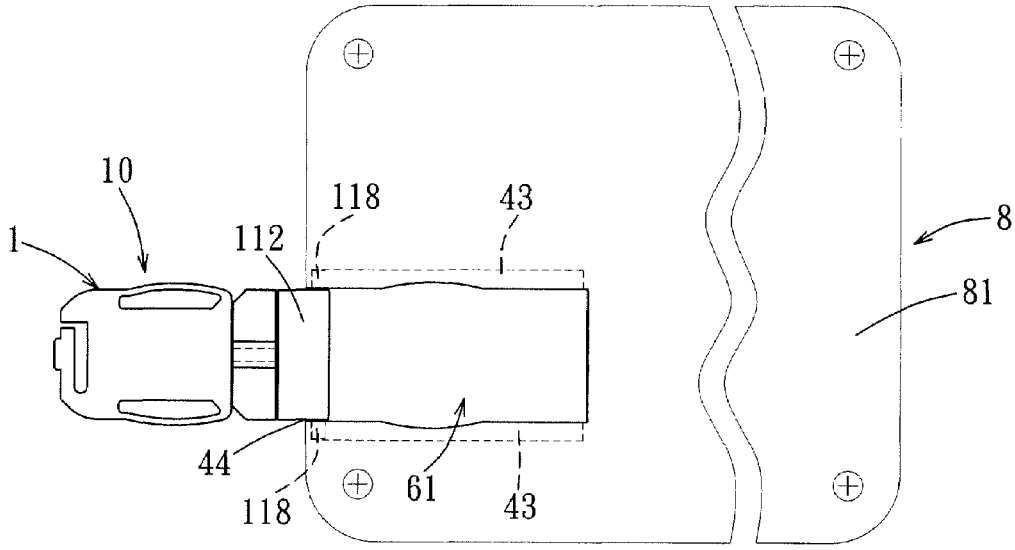
FIG. 7 is a fragmentary side view to illustrate the first insert plate of the second preferred embodiment in a position of use.

Referring to FIGS. 6 and 7, the second preferred embodiment of an electronic device 8 having a car power plug 10 according to the present invention is substantially similar to the first preferred embodiment in terms of the components. The difference resides in that the first receiving recess 61 has an opening 44 formed in a lateral edge of the housing 80, and there are provided two slide grooves 43 which extend respectively along two opposite sides of the first receiving recess 61 that are perpendicular to the opening 44. Furthermore, the positioning portion 112 of the first insert plate 1 is formed with two sliding blocks 118 disposed respectively on the two opposite sides thereof. The sliding blocks 118 are respectively slidable along the two slide grooves 43 such that the first insert plate 1 is movable between the stowage position and the position of use in which the first insert plate 1 projects outwardly of the opening 44.

Figure 8:
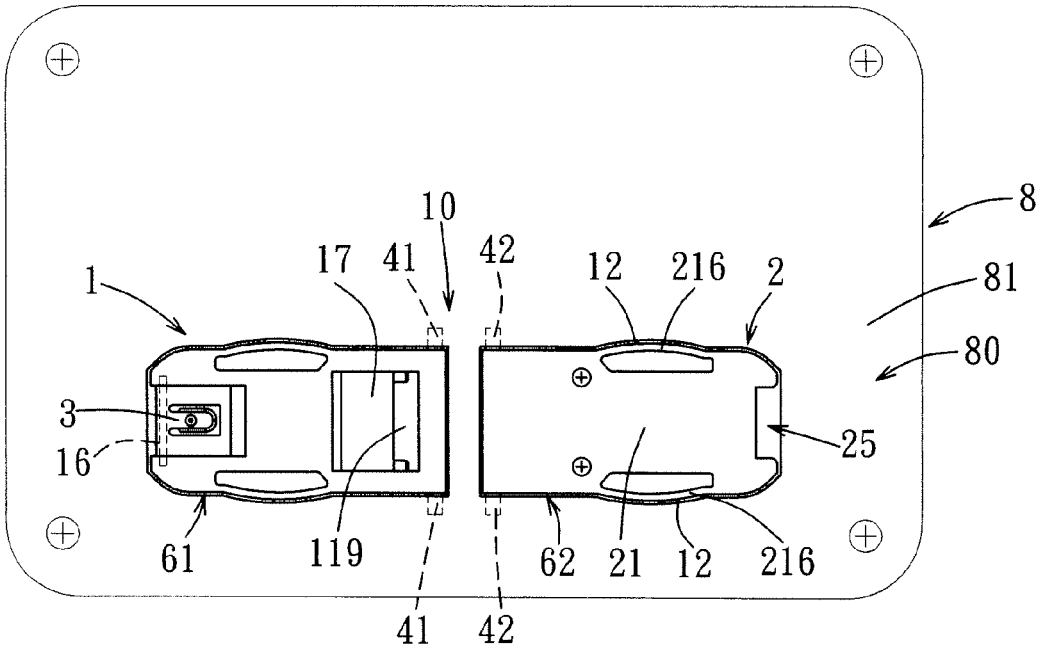
FIG. 8 is a side view to illustrate the third preferred embodiment of an electronic device having a car power plug according to the present invention, showing first and second insert plates disposed in a stowage position.
Figure 9:
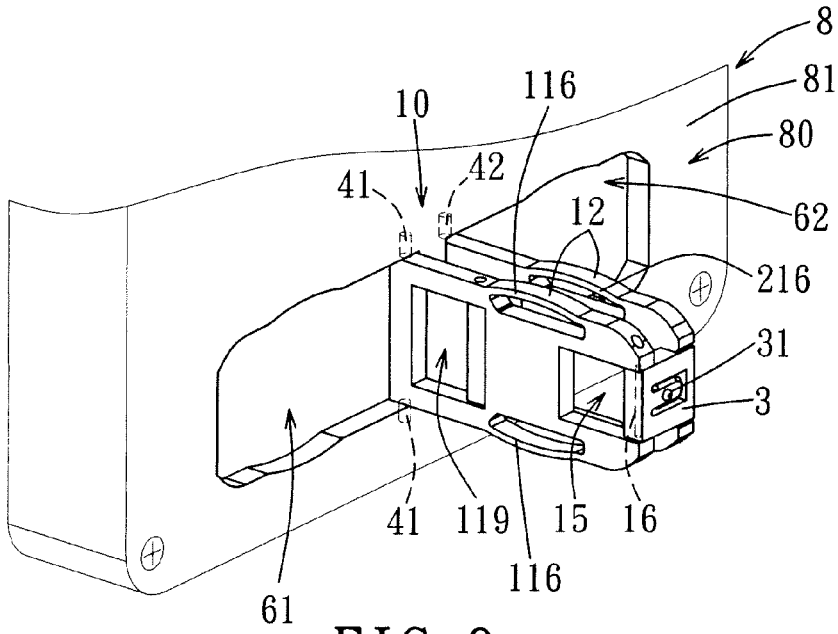
FIG. 9 is a fragmentary perspective view to illustrate the first and second insert plates of the third preferred embodiment in a position of use.

Referring to FIGS. 8 and 9, the third preferred embodiment of an electronic device 8 having a car power plug 10 according to the present invention differs from the first preferred embodiment in that the car power plug 10 further includes a generally rectangular second insert plate 2 adjacent to the first insert plate 1, and a second receiving recess 62 adjacent to the first receiving recess 61.

Similar to the first insert plate 1, the second insert plate 2 includes an insulating body 21 that is dimensioned with reference to the diameter of the cigarette lighter socket, and conducting portions 12 provided respectively on opposite sides of the insulating body 21. The insulating body 21 of the second insert plate 2 is formed with two coaxial second pivot pins 42 that project respectively from two opposite sides of the insulating body 21 such that the two second pivot pins 42 are pivotally coupled at one end of the second receiving recess 62 proximate to the first receiving recess 61 to permit pivotal movement of the second insert plate 2 between a stowage position, where the second insert plate 2 is stowed in the second receiving recess 62, and a position of use, where the second insert plate 2 is away from the second receiving recess 62 for insertion into the cigarette lighter socket.

According to the third preferred embodiment, a front end of the first insert plate 1 is provided with a U-shaped indentation 15 to permit pivotal mounting of the conducting member 3 therein. A conducting shaft 16 extends through one end of the conducting member 3 such that the conducting member 3 is rotatable about the conducting shaft 16 between a closing position and a non-closing position. The closing position refers to a state in which, when the first and second insert plates 1, 2 are in their positions of use, the conducting member 3 is pivotable to a position where the conducting member 3 may straddle the front ends of the first and second insert plates 1, 2. The non-closing position refers to a state in which, when the first and second insert plates 1, 2 are in their stowage positions, the conducting member 3 is pivotable to be disposed in the U-shaped indentation 15, and is co-planar with the first insert plate 1. The front end of the second insert plate 2 is formed with a U-shaped indentation 25. When the conducting member 3 is disposed in the closing position, the conducting member 3 may be received and retained in the U-shaped indentation 25.

The conducting member 3 is a metal plate formed with a resilient plate 31 that is adapted to abut against the positive power terminal of the cigarette lighter socket when the car power plug 10 is inserted into the cigarette lighter socket. The resiliency of the resilient plate 31 permits relatively stable contact of the resilient plate 31 with the positive power terminal to prevent slipping of the car power plug 10 from the cigarette lighter socket, which may result in power interruption.

Similar to the first insert plate 1, the insulating body 21 of the second insert plate 2 has two resilient wings 216 projecting outwardly and respectively from two opposite sides thereof and adapted to contact the inner wall surface of the cigarette lighter socket. The conducting portions 12 are respectively provided on outer surfaces of the resilient wings 116, 216. It is noted that, similar to the first preferred embodiment, there may be only one resilient wing 116, 216, so long as the conducting portion 12 thereon is able to come into contact with the inner wall surface of the cigarette lighter socket. Those having ordinary skill in the art to which the present invention pertains should readily appreciate that the present invention can be modified in the number of components or elements.

Similar to the first preferred embodiment, the conducting portions 12 and the conducting member 3 of the car power plug 10 according to the third preferred embodiment may be connected electrically and respectively to the electronic device 8 in various ways. For example, the first and second insert plates 1, 2 may be sprayed with an electrically conductive paint to form electrical connection paths, or may be plated with a conductive metal layer to form electrical connection paths. Alternatively, state-of-the-art injection forming techniques may even be employed to embed painted wires or metal wires into the first and second insert plates 1, 2 to form electrical connection paths. Those having ordinary skill in the art to which the present invention pertains should be familiar with various ways to establish electrical connections.

The first insert plate 1 further includes a securing member 17 having one end disposed pivotally in an accommodation hole 119 formed in the insulating body 11 of the first insert plate 1. When the first and second insert plates 1, 2 are both in their positions of use, the securing member 17 is pivotable toward the second insert plate 2 such that the other end of the securing member 17 abuts against the second insert plate 2 to enhance stability between the first and second insert plates 1, 2. When the first and second insert plates 1, 2 are both disposed in their stowage positions, the securing member 17 is located in the accommodation hole 119 and is co-planar with the insulating body 11 of the first insert plate 1.

In sum, in contrast to the conventional cylindrical car power plug, the first and second insert plates 1, 2 according to the present invention have a plate-like structure that permits a reduction in manufacturing costs and that facilitates carrying of the electronic device 8 having the same. Furthermore, the present invention is configured to be stowable in the receiving recess 61, 62 of the electronic device 8 so as to be integrated with the electronic device 8, so that it is not necessary to additionally connect to a conventional cylindrical car plug and a power adapter in order to obtain power via the cigarette lighter socket. Moreover, the provision of the car power plug 10 according to present invention will not increase the size of the electronic device 8.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electronic device having a car power plug configured for insertion into a car cigarette lighter socket to obtain power therefrom, said electronic device comprising:

a housing;

a first input terminal disposed in said housing;

a second input terminal disposed in said housing; and said car power plug, wherein said car power plug comprises:

a first insert plate disposed on said housing, said first insert plate including an insulating body dimensioned with reference to a diameter of the cigarette lighter socket and configured to be inserted removably into the cigarette lighter socket, and a conducting portion disposed on one side of the insulating body and connected electrically to said second input terminal; and a conducting member disposed at a front end of said first insert plate and connected electrically to said first input terminal.

2. The electronic device having a car power plug according to claim 1, wherein said housing has one face formed with a first receiving recess, said first insert plate being accommodated in said first receiving recess.

3. The electronic device having a car power plug according to claim 2, wherein said first insert plate is switchable between a stowage position, where said first insert plate is stowed in said first receiving recess, and a position of use, where said first insert plate is away from said first receiving recess.

4. The electronic device having a car power plug according to claim 3, wherein said first insert plate is a generally rectangular plate, and said first receiving recess is a rectangular recess dimensioned with reference to said first insert plate, said first receiving recess having an opening formed in a lateral edge of said housing, and two slide grooves extending respectively along two opposite sides of said first receiving recess that are perpendicular to said opening, said first insert plate having two opposite sides engaging slidably and respectively said two slide grooves, said first insert plate being movable between the stowage position and the position of use in which said first insert plate projects outwardly of said opening.

5. The electronic device having a car power plug according to claim 3, wherein said insulating body of said first insert plate has one end portion connected pivotally to a rear face of said housing and located in said first receiving recess, such that said first insert plate is pivotable relative to said first receiving recess between the stowage position and the position of use.

6. The electronic device having a car power plug according to claim 5, wherein said insulating body of said first insert plate is formed with two first pivot pins that are disposed in said first receiving recess such that said first insert plate is pivotable about said first pivot pins between the stowage position and the position of use.

7. The electronic device having a car power plug according to claim 6, wherein said insulating body is formed with a resilient wing that projects outwardly from one of two opposite sides of said insulating body and that is configured to contact an inner wall surface of the cigarette lighter socket, said conducting portion being provided on an outer surface of said resilient wing.

8. The electronic device having a car power plug according to claim 7, wherein said front end of said first insert plate is formed with a resilient arm, said conducting member being provided on a front side of said resilient arm.

9. The electronic device having a car power plug according to claim 8, wherein said insulating body of said first insert plate has a positioning portion and a plug portion which are disposed respectively proximate to and distal from said housing when said first insert plate is in the position of use, said first insert plate further including a pivot shaft extending from one end of said plug portion that is proximate to said housing to said positioning portion, and a blocking member interposed between said plug portion and said positioning portion, said blocking member being rotatable about said pivot shaft between a non-fixing position, where said blocking member is co-planar with said plug portion, and a fixing position, where said blocking member is not co-planar with said plug portion.

10. The electronic device having a car power plug according to claim 5, wherein said car power plug further includes a second insert plate disposed adjacent to said first insert plate, said housing being further formed with a second receiving recess disposed adjacent to said first receiving recess, said second insert plate including an insulating body dimensioned with reference to the diameter of the cigarette lighter socket and pivotally connected at one end of said second receiving recess that is proximate to said first receiving recess such that said second insert plate is pivotable between a stowage position, where said second insert plate is stowed in said second receiving recess, and a position of use where said second insert plate is away from said second receiving recess for insertion into the cigarette lighter socket.

11. The electronic device having a car power plug according to claim 10, wherein said insulating body of said second insert plate has one side formed with a resilient wing that projects outwardly, said second insert plate having a conducting portion disposed on an outer surface of said resilient wing.

12. The electronic device having a car power plug according to claim 10, wherein said insulating body of said first insert plate is formed with an accommodation hole, said first insert plate further including a securing member having one end pivotally disposed in said accommodation hole, said securing member being pivotable toward said second insert plate such that the other end of said securing member abuts against said second insert plate when said first and second insert plates are in their positions of use, said securing member being received in said accommodation hole and being co-planar with said insulating body of said first insert plate when said first and second insert plates are in their stowage positions.

13. The electronic device having a car power plug according to claim 10, wherein said insulating body of said second insert plate is formed with two second pivot pins that are disposed in said second receiving recess such that said second insert plate is pivotable about said second pivot pins.

14. The electronic device having a car power plug according to claim 13, wherein said first insert plate has a front end formed with an indentation to permit pivotal mounting of said conducting member therein, said second insert plate having a front end, said conducting member being pivotable to straddle said front ends of said first and second insert plates when said first and second insert plates are disposed in their positions of use, said conducting member being pivotable to be received in said indentation and to be co-planar with said first insert plate when said first and second insert plates are in their stowage positions.

15. The electronic device having a car power plug according to claim 14, wherein said insulating body of said first insert plate has a front end provided with a conducting shaft that extends through one side of said conducting member such that said conducting member is rotatable about said conducting shaft between a closing position, wherein said conducting member is co-planar with said first insert plate, and a non-closing position, wherein said conducting member straddles said first and second insert plates.

16. A car power plug configured for insertion into a car cigarette lighter socket to obtain power therefrom, said car power plug comprising:

an insert plate including an insulating body in form of a plate;

a conducting portion provided on one side of said insulating body; and a conducting member provided at a front end of said insert plate;

wherein said insulating body is formed with a resilient wing that projects outwardly from one of two opposite sides thereof, said conducting portion being provided on an outer surface of said resilient wing, and wherein said front end of said insert plate is formed with a resilient arm, said conducting member being provided on a front side of said resilient arm.

17. An electronic device having a car power plug, comprising:

a housing;

a first input terminal disposed in said housing;

a second input terminal disposed in said housing; and said car power plug, wherein said car power plug comprises:

a first insert plate disposed pivotally on said housing, said first insert plate including an insulating body and a conducting portion disposed on one side of said insulating body, said conducting portion being connected electrically to said second input terminal, a second insert plate disposed pivotally on said housing adjacent to said first insert plate, said first and second insert plates being pivotable between a stowage position where said first and second insert plates are flush with said housing, and a position of use, where said first and second insert plates project from said housing, and a conducting member foldably straddling said first and second insert plates and connected electrically to said first input terminal.

18. The electronic device having a car power plug according to claim 17, wherein said housing has one side formed with a first receiving recess, and a second receiving recess adjacent to said first receiving recess, said first and second insert plates being accommodated respectively in said first and second receiving recesses when said first and second insert plates are at the stowage position.

* * * * *